US007861379B2

(12) United States Patent
Peters et al.

(10) Patent No.: US 7,861,379 B2
(45) Date of Patent: Jan. 4, 2011

(54) SYSTEM FOR SELECTIVELY LOCATING A DOOR WITHIN A FRAME

(76) Inventors: Abram D. Peters, 2625 Coon Rd., Lima, OH (US) 45806; Jake Peters, 1310 Stevick Rd., Elida, OH (US) 45807

( * ) Notice: Subject to any disclaimer, the term of this patent is extended or adjusted under 35 U.S.C. 154(b) by 280 days.

(21) Appl. No.: 12/151,655

(22) Filed: May 8, 2008

(65) Prior Publication Data

US 2008/0276418 A1 Nov. 13, 2008

Related U.S. Application Data

(60) Provisional application No. 60/928,337, filed on May 9, 2007.

(51) Int. Cl.
*E05D 11/06* (2006.01)

(52) U.S. Cl. ..... 16/375; 16/319; 16/387

(58) Field of Classification Search ..... 16/375, 16/221, 277, 297, 321, 335, 387, 319
See application file for complete search history.

(56) References Cited

U.S. PATENT DOCUMENTS 3,066,349 A * 12/1962 Youngdale ..... 16/302
3,255,484 A * 6/1966 MacDonald ..... 16/278
3,381,332 A * 5/1968 Jerila ..... 16/327
3,550,186 A * 12/1970 Swartz ..... 16/278
3,577,840 A * 5/1971 Buberniak ..... 16/332
3,590,420 A * 7/1971 Salice ..... 16/335
3,623,185 A * 11/1971 Cartwright et al. ..... 16/335
3,728,757 A * 4/1973 Lloyd ..... 16/303
3,822,440 A * 7/1974 Stansbury et al. ..... 16/303
3,837,043 A * 9/1974 Coe ..... 16/303
3,972,090 A * 8/1976 Holmes ..... 16/321
4,654,930 A * 4/1987 Lautenschlager et al. ..... 16/288
4,692,964 A * 9/1987 DeBruyn ..... 16/367
4,716,622 A * 1/1988 DeBruyn ..... 16/297
4,736,491 A * 4/1988 Mertes ..... 16/358
4,827,569 A * 5/1989 Mertes ..... 16/288
4,891,862 A * 1/1990 Holan ..... 16/278

* cited by examiner

*Primary Examiner*—William L. Miller
(74) *Attorney, Agent, or Firm*—Marshall & Melhorn LLC

(57) ABSTRACT

A system for selectively locating a door within a frame may include a frame, a door selectively located within the frame and a hinge. The hinge has a frame attachment portion and a door attachment portion. The portions are pivotally connected to one another via a pin. The frame attachment portion and door attachment portion cooperate to cause an outside surface of the door to be flush with an outside surface of the frame when the door is substantially within the frame. The frame attachment portion has a roller flange extending substantially transverse to the frame attachment portion that selectively engages with a roller on the door attachment portion.

12 Claims, 5 Drawing Sheets

SECTION A-A

SYSTEM FOR SELECTIVELY LOCATING A DOOR WITHIN A FRAME

RELATED APPLICATIONS

This application claims benefit from U.S. Patent Application Ser. No. 60/928,337 filed on May 9, 2007 which is incorporated by reference in its entirety.

FIELD OF THE INVENTION

The present invention is related to a system for selectively locating a door within a frame, including a hinge, such as, but not limited to, a hinge for cabinets. More particularly, the present invention relates to a cabinet hinge that largely remains hidden from sight when the cabinet door is closed, that assists in maintaining the cabinet door in a closed position and that results in the door being mounted substantially flush with its associated frame.

SUMMARY OF THE INVENTION

In one embodiment, a hinge has a frame attachment portion and a door attachment portion. The frame attachment portion may have an open area enclosed by a perimeter portion, at least one pin housing, and a roller flange. The roller flange may extend from, and it may be perpendicular to the frame attachment portion. Preferably, the perimeter portion, the pin housing and the roller flange are unitary with the frame attachment portion.

The door attachment portion may have an edge portion and an inner and outer portion. The edge portion may have a complementary shape to the open area of the frame attachment portion for being selectively received therein. The inner portion and the outer portion may be perpendicular to the edge portion. The outer portion may have a flange extending perpendicular to the door attachment portion. A pin may extend perpendicularly to the flange wherein a spring is located about the pin. The spring may have a first leg extending in a first direction and a second leg extending in a second opposite direction. The second leg supports a roller thereon. It is preferred that the edge portion, the inner portion, the flange and a pin housing on the edge portion are unitary with one another.

In another embodiment, the hinge may have a U-shaped frame attachment portion. The frame attachment portion may be comprised of a first leg, a second leg and a leg connector forming an inner edge that defines an open area. The first leg and the second leg each have separate pin housings. The legs, the leg connector and the pin housings are unitary with one another.

The frame attachment portion may also comprise a roller flange, unitary with the leg connector, which extends perpendicularly from the inner edge of the frame attachment portion.

The door attachment portion may have an edge portion with a complementary shape to the open area for being selectively received therein and a pin housing portion. A roller arm portion may also be provided that is transverse to the edge portion. The roller arm portion may define two roller arms. The roller arms are parallel to one another and extend perpendicular to the roller arm portion. Preferably, the edge portion, the roller arm portion, the pin housing portion and the roller arms are unitary.

Another embodiment of the invention includes a system for selectively locating a door within a frame comprising a frame, a door selectively located within the frame and a hinge. The hinge has a frame attachment portion and a door attachment portion. The portions are pivotally connected to one another via a pin. The frame attachment portion and door attachment portion cooperate to cause an outside surface of the door to be flush with an outside surface of the frame when the door is substantially within the frame. The door attachment portion comprises a male portion that is selectively and entirely received within a hollow complementary shaped female portion on the frame attachment portion when the door is substantially within the frame. The frame attachment portion has a roller flange extending substantially transverse to the frame attachment portion that selectively engages with a roller on the door attachment portion. The roller flange has integrally formed therewith a roller securing portion.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts herein. Hence, specific dimensions, directions or other physical characteristics relating to the embodiments disclosed are not to be considered as limiting unless expressly stated otherwise.

Figure 1:
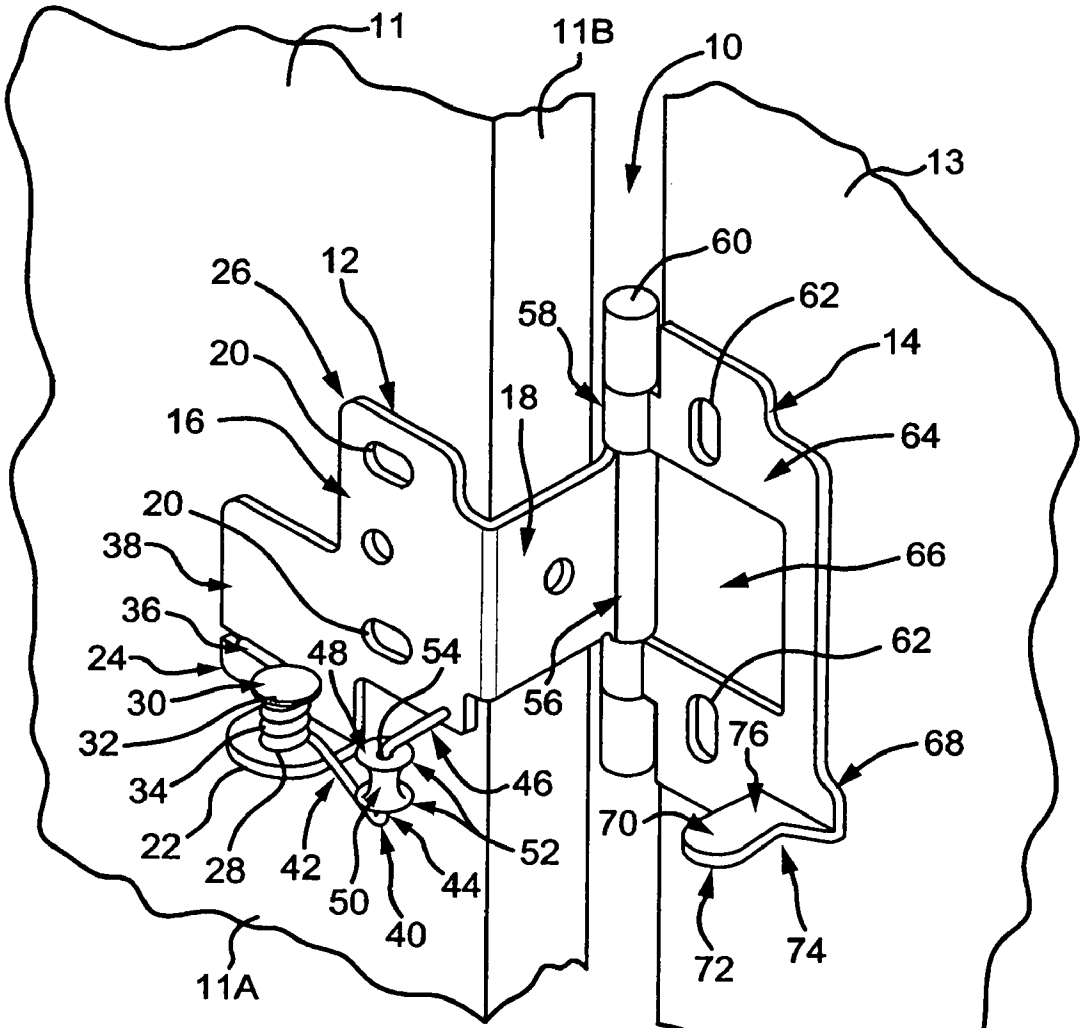
FIG. 1 is one schematic perspective view on one embodiment of a hinge.

Turning now to FIG. 1, a hinge 10 is depicted. A single hinge 10, such as depicted in FIG. 1, can be used to pivotally attach a door 11 to a door frame 13. The present application will describe a single hinge 10. However, it can be readily appreciated from the following description that additional hinges can be simultaneously utilized. If multiple hinges are used to connect a door to a door frame, they would operate in substantially the same fashion as the single hinge 10 described below. Additionally, the present application describes and depicted different embodiments of hinges, which may be used with one another on the same door and frame.

The hinge 10 may have a door attachment portion 12 and a frame attachment portion 14. The door attachment 12 portion may be comprised of two portions that are substantially perpendicular to one another. Preferably, the two portions are one-piece and integrally formed with one another. The first portion may be such as inner portion 16 and the second portion may be such as an edge portion 18. The inner portion 16 connects to, or is located adjacent, an inner surface 11A of the door 11. The edge portion 16 connects to, or is located adjacent, an edge 11B of the door 11.

Based on the foregoing, it can be appreciated that the door attachment portion 12 fits against the edge portion of a door and the inner portion of a door, which are generally perpendicular to one another.

The door attachment portion 12 may be located anywhere along the length of a door. If two or more hinges are utilized, they may be spaced a predetermined distance apart from one another.

The door attachment portion 12 may have one or more apertures 20. The apertures 20 receive mechanical-type fasteners, such as, but not limited to, screws (not shown), for securing the door attachment portion 12 to a door. The apertures 20 may be located in the inner portion 16 and/or the edge portion 18.

An upstanding flange 22 is provided on the inner portion 16 of the door attachment portion 12. While the upstanding flange 22 is depicted on one portion of the inner portion 16 in FIG. 1, the flange 22 may be located anywhere on the inner portion 16. For example, while the figure depicts the flange 22 on a lower portion 24 of the inner portion 16 of the door attachment portion 12, the flange 22 can be located on an upper portion 26 of the inner portion 16 or anywhere in between the lower portion 24 and the upper portion 26 without limitation.

The flange 22 may have an aperture 28 located therein. A pin 30 may be located in the aperture 28. The pin 30 may be defined by a body portion (not shown) that has a rod-like shape. The pin 30 may also have a head portion 32. The head portion 32 has a greater diameter than the body portion.

Located about the body portion 30 of the pin and preferably at least partially between the head portion 32 and the flange 22, a spring 34 is provided. The spring 34 may have any number of windings and be constructed of any resilient material. By way of example only, the spring 34 may be constructed of metal or plastic.

The spring 34 preferably has two outwardly extending legs. The first leg 36 extends downwardly and it is biased downwardly against the inner portion 16 of the hinge 10 adjacent an outer portion 38 of the hinge 10 in the depicted embodiment. The second leg 40 has a first portion 42 that extends upwardly from the inner portion 16 of the hinge 10 and toward the edge portion 18 of the hinge 10. A second portion 44 of the second leg 40 extends in a perpendicular fashion from the first portion 42. A third portion 46 of the second leg 40 extends perpendicularly from the second portion 44 so that it terminates in the inner portion 16 of the hinge 10. Preferably, the third portion 46 is located, such as removably, but securedly located, within the inner portion 16. It can be appreciated from the foregoing, as well as FIG. 1, that the second leg 40 extends above the inner portion 16.

A roller 48 is preferably located on the second leg 44. Preferably, the roller 48 may be located on the second portion 44 of the second leg 40 such that the roller 48 is above the hinge 10. The roller 48 may be above the inner portion 16 of the hinge 10 but it may or may not be located directly above the inner portion 16. Instead, if may be offset from the inner portion 16.

The roller 48 may be constructed of any material such as, but not limited to, plastic, metal and/or ceramic. The roller 48 may have a body portion 50 bounded by one or two upstanding portions 52. The second portion 44 of the second leg 40 preferably extends through the body portion 50 of the roller 48 via an aperture 54 extending through the roller 48. The roller 48 may be rotatably mounted on the second portion 44 of the second leg 40.

The edge portion 18 of the hinge 10 terminates in at least one pin housing 56. The pin housing 56 is integrally formed and one-piece with the edge portion 18. Similarly, the frame portion 14 of the hinge 10 has at least one pin housing 58 that is also integrally formed and one piece with the frame portion 14. The pin housings 56, 58 align with one another so that a pin 60 can be located through the pin housing 56 of the edge portion 18 and the pin housing 58 of the frame portion 14. As such, the edge portion 18 of the door attachment portion 12 and the frame portion 14 are pivotally connected to one another.

The frame portion 14 may have one or more apertures 62 for receiving mechanical-type fasteners therein. The mechanical fasteners may be such as, but not limited to, screws (not shown). The frame portion 14 may be attached via the mechanical fasteners to the frame of the cabinet or door.

The frame portion 14 preferably has a perimeter portion 64 that defines a substantially open area 66. In a preferred embodiment, the perimeter portion 64 is integrally formed with the pin housing 58 of the frame portion 14.

The open area 66 may have approximately the same size, shape and dimensions as the edge portion 18 of the door portion 12. It can be appreciated that when the door attached to the hinge 10 is rotated to a closed position against the frame that the edge portion 18 fits into the open area 66 of the frame portion 14 of the hinge 10. This design, where the edge portion 18 fits within the frame portion 14, permits the hinge 10 to be very narrow. Thus, only a small gap (not shown) is required between the door frame and the door.

The frame portion 14 also preferably comprises a flange support portion 68. The flange support portion 68 is substantially planar with the frame portion 14 and it extends inwardly into or beyond the frame of the cabinet or door. In certain cases, the flange support portion 68 may be cantilevered from the frame.

A flange 70 is located on the flange support portion 68. The flange 70 may be located anywhere on the flange support portion 68 but preferably it is located on the flange support portion 68 so that it is substantially aligned with the roller 48 on the door portion 12.

The flange 70 on the frame portion 14 preferably has a curvilinear upper portion 72 and a groove 74. The groove 74 is preferably located on a rear portion 76 of the flange 70. It can be appreciated that when the door is pivoted toward the frame, the roller 48 engages the curvilinear upper portion 72 of the flange 70 on the frame portion 14. The roller 48 moves over the upper portion 72 as the door is moved closer to the frame. Specifically, the roller 48 moves rearwardly on the upper portion 72. The roller 48 is pushed upwardly by the shape of the flange 70, thus biasing the second leg 40 which is of course attached to the roller 48 upwardly against the spring 34. Once the door is almost in the fully closed position and against the frame, the roller 48 moves into the groove 74 of the flange 70. The groove 74 helps to secure the door from opening without the door being pulled open.

It can be appreciated from the foregoing that the hinge 10 enables the door to sit flush with the frame, thus providing a substantially planar door and frame surface. Additionally, the hinge 10 biases the door shut in the frame so that it is unlikely to open without a force being applied to the door. It can also be appreciated that in the closed position, the only parts of the hinge 10 that can be seen are pin housings 56, 58 and perhaps a decorative portion of the pin 60 that may extend above and below the housings 56, 58.

Figure 2:
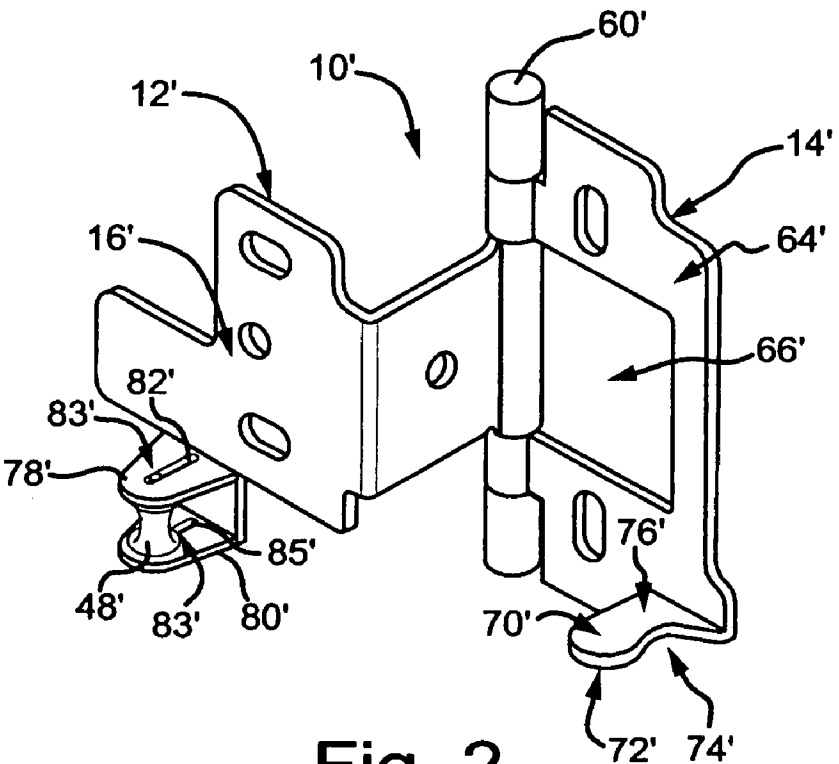
FIG. 2 is a schematic perspective view of another embodiment of a hinge.
Figure 4D:
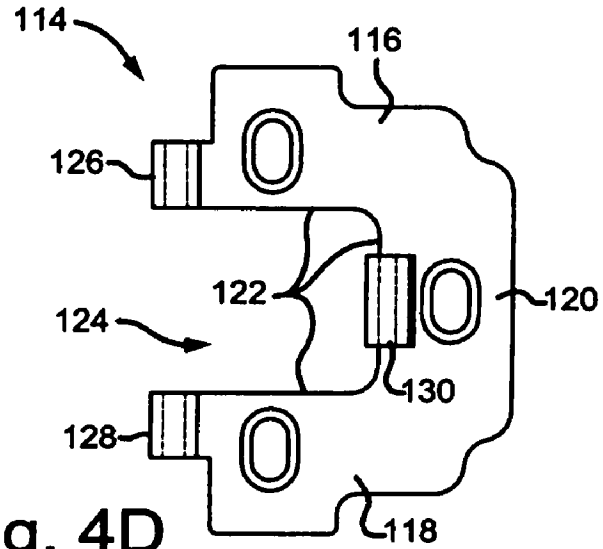
FIGS. 4A-D are schematic views of a component of another embodiment of a hinge of the present invention.
Figure 4C:
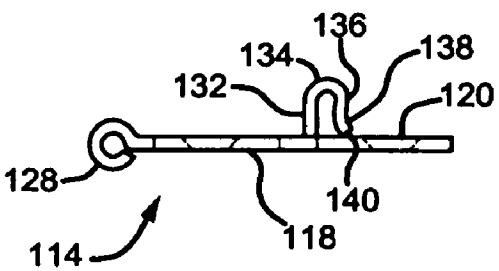
Figure 4B:
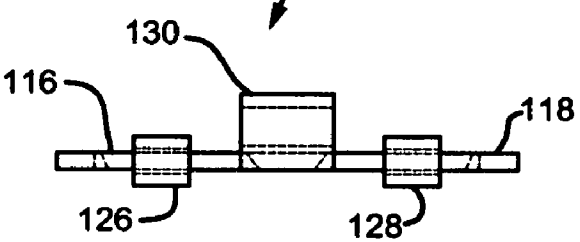
Figure 4A:
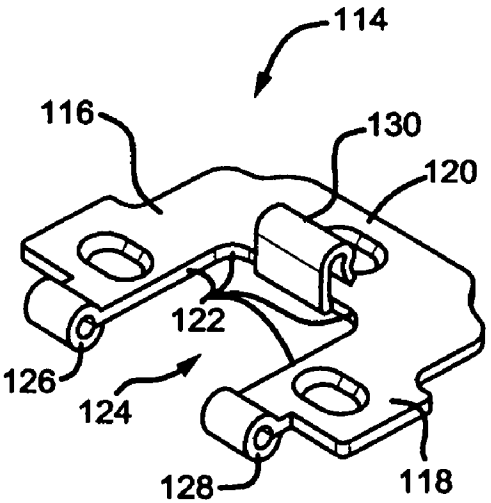
Figure 5B:
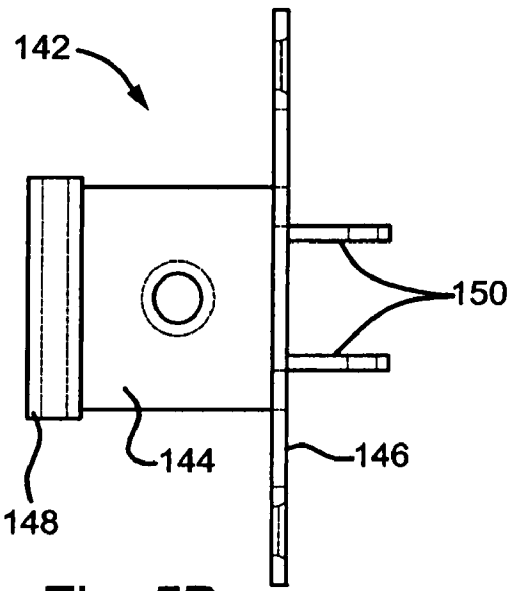
FIGS. 5A-D are schematic views of another component used with the hinge of FIG. 4.
Figure 5C:
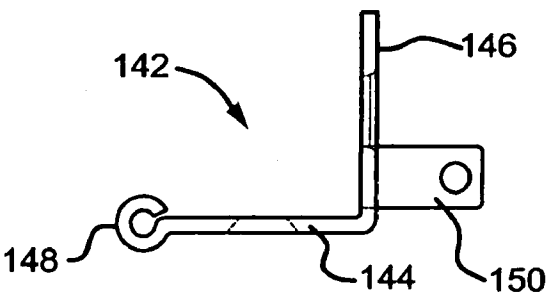
Figure 5A:
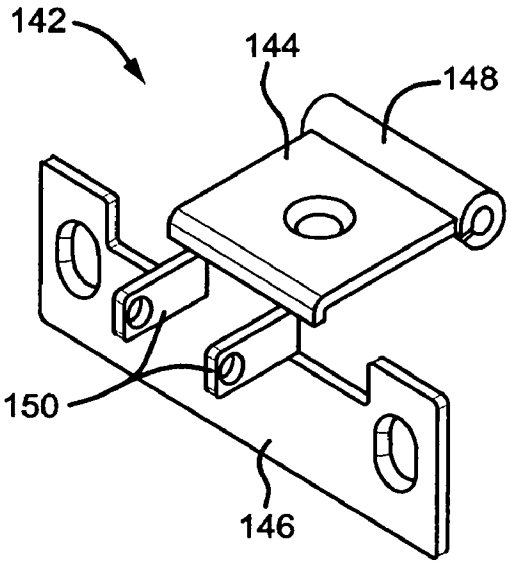
Figure 5D:
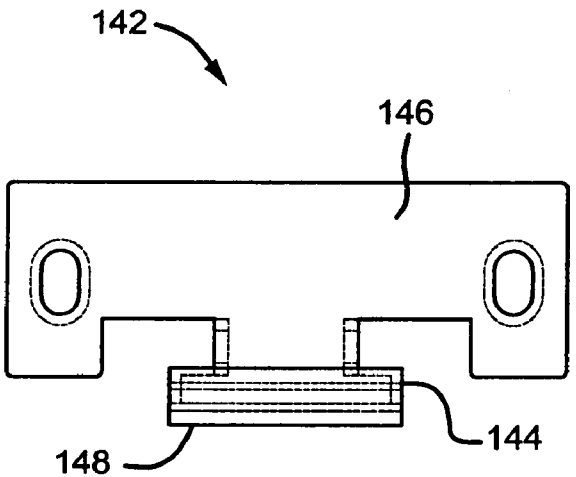

An alternative embodiment of a hinge 10' is depicted in FIG. 2. FIG. 2 utilizes reference numbers with a prime for similar features discussed above and depicted in FIG. 1. The prime will also be used with new features of the hinge 10'

A first upstanding flange 78' is provided on an inner portion 16' of a door attachment portion 12' of a hinge 10'. A second upstanding flange 80' is provided adjacent the first upstanding flange 78'. More preferably, the second upstanding flange 80' is located parallel to and cantilevered out from the first upstanding flange 78' on the inner portion 16' of the door attachment portion 12'.

A first slot 82' may be located through the first upstanding flange 78'. Similarly, a second slot 85' may be located through the second upstanding flange 80'. It is preferred that the first slot 82' and the second aperture 85' are substantially aligned with one another.

A roller 48' is mounted between the first flange 78' and the second flange 80'. The roller 48' may be similar in shape and function to the roller 48 discussed above.

When the door is rotated toward the door frame (the location of which can be readily appreciated from the door and door frame depicted in FIG. 1), at a predetermined orientation of the two, the roller 48' begins to engage the upstanding flange 70'. The roller 48' extends and rolls over an upper portion 72' of the flange 70'. The upward curving nature of the upper portion 72' of the flange 70' biases the roller 48' against a biasing member discussed below. When the door is located almost entirely in the door frame, the roller 48' moves into a groove 74' on the rear portion 76' of the upstanding flange 70'. The groove 74' selectively keeps the roller 48' from rolling backward and thus the door is kept selectively closed in the door frame.

The roller 48' is preferably biased in an upper portion 83' of the slots 82', 85'. One or more biasing members (not shown) may be used. The biasing members may be such as, but are not limited to, springs of any known material, design, orientation or location on the flange 78' and/or 80' or the inner portion 16'. Regardless of what biasing member is used, it can be appreciated that the biasing member selectively permits the roller 48' to move within the slots 82', 85'.

In view of the foregoing, it can be appreciated that the hinge 10' enables the door to sit flush with the frame and provide a substantially planar door and frame surface. Additionally, the hinge 10' biases the door shut in the frame so that it is unlikely to open without a force, such as someone pulling the door open. It can also be appreciated that in the closed position, the only parts of the hinge 10' that can be seen are the pin housings 56', 58' and perhaps a decorative portion of the pin 60' that may extend above and below the housings 56', 58'.

Figure 3:
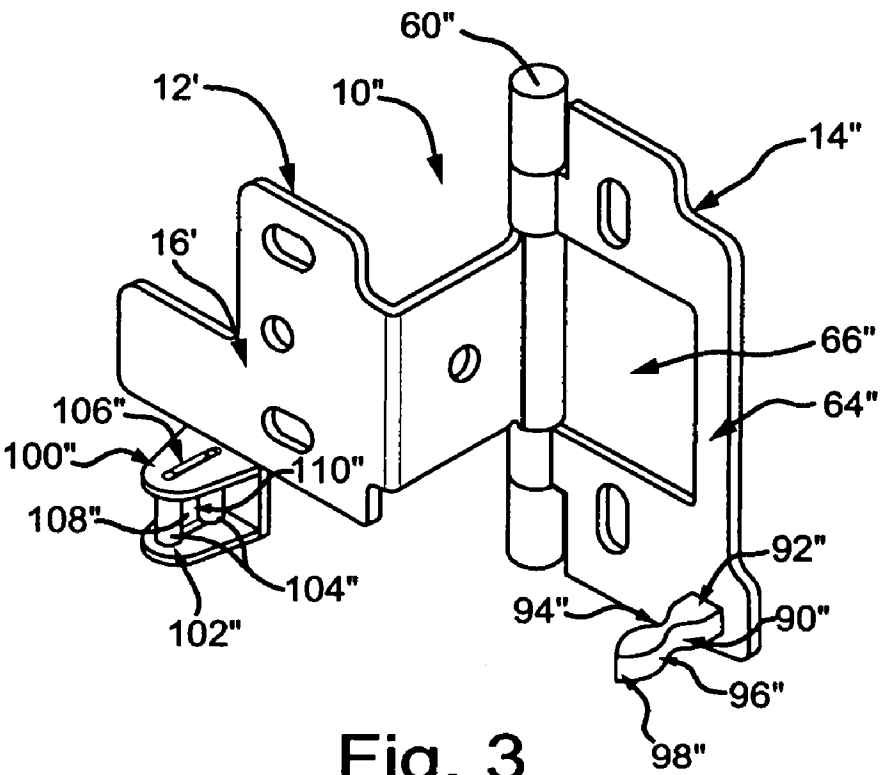
FIG. 3 is a schematic perspective view of another embodiment of a hinge.

Turning now to FIG. 3, yet another embodiment of a hinge 10" is depicted. Features of this hinge 10" having similar features to those described above and depicted in FIGS. 1-2 will be identified in FIG. 3 with a double prime.

A frame portion 14" of the hinge 10" has an upstanding portion 90". The upstanding portion 90" may be located on a perimeter portion 64" of the frame portion 14".

The upstanding portion 90" may be comprised of a plurality of different shapes. One preferred shape is depicted in FIG. 3. The depicted upstanding portion 90" is curvilinear in shape having a wide base portion 92", a narrower middle portion 94" and a wedge shaped upper portion 96". The upper portion 96" terminates in an edge or a point 98".

A first upstanding flange 100" is provided on an inner portion 16" of a door attachment portion 12" of the hinge 10". A second upstanding flange 102" is provided adjacent the first upstanding flange 100". More preferably, the second upstanding flange 102" is located parallel to and may be cantilevered out from the first upstanding flange 100" on the inner portion 16" of the door attachment portion 12".

A pair of rollers 104" are mounted to, and oriented substantially perpendicularly between, the flanges 100", 102". The rollers 104" may rotate with respect to the flanges 100", 102" and/or move up and down within the flanges 100", 102" via a slot 106" in the flange 100" and a slot 108" in flange 102".

A gap 110" may be located between the two rollers 104". The rollers 104" are biased toward one another by one or more biasing members (not shown) associated in or with the upstanding flanges 100", 102". The biasing members may be as discussed above for the embodiment depicted in FIG. 2. The rollers 104" are aligned with the upstanding portion 90" on the frame portion 14".

When the door is moved toward the frame, the pair of rollers 104" on the door portion 102" of the hinge 10" moves toward the upstanding portion 90". At a predetermined orientation of the door and the frame, the upper portion 96" of the upstanding portion 90" engages the rollers 104". As the door is moved closer to the frame, the wedge shape of the upper portion 96" divides the rollers 104" and/or the rollers 104" begin to rotate in opposite directions to one another to accommodate the upper portion 96". Once a maximum thickness of the wedge shape passes through the rollers, the rollers 104" are urged toward one another again as they begin to, and actually pass over, the thinner middle portion 94" of the upstanding portion 90". When the rollers 104" reach the middle portion 94" of the upstanding portion 90", the door is located within frame.

It can be appreciated from the foregoing that the hinge 10" enables the door to sit flush with the frame, thus providing a substantially planar door and frame surface. Additionally, the hinge 10" biases the door shut in the frame so that it is unlikely to open without a force, such as someone pulling the door open. It can also be appreciated that in the closed position, the only parts of the hinge 10" that can be seen are the pin housings 56", 58" of the hinge 10" and perhaps a decorative portion of the pin 60" that may extend above and below the housings 56", 58".

Turning now to FIGS. 4, 5 and 6, another embodiment of the present invention is depicted. A hinge 112 is provided having a U-shaped frame attachment portion 114 attached to a frame 113, such as a cabinet frame. The frame attachment portion 114 comprises a first leg 116, a second leg 118 and a leg connector 120. The legs 116, 118 and the leg connector 120 form an inner edge 122 that defines an open area 124. The first leg 116 and the second leg 118 each have separate pin housings 126, 128. The legs 116, 118, the leg connector 120 and the pin housings 126, 128 are preferably one-piece and unitary.

A roller flange 130, that is preferably unitary with the leg connector 120, extends perpendicularly from the inner edge 122 of the frame attachment portion 114. The roller flange 130 has a rear portion 132, which is attached to the leg connector 120, a curvilinear upper portion 134, a middle portion 136 defining a roller groove 138 and a terminal portion 140 terminating adjacent the attachment portion 114.

A door attachment portion 142 of the hinge 112 is also provided which preferably comprises an edge portion 144 and a roller arm portion 146. The door attachment portion is secured to a door 143, such as a cabinet door. The edge portion 144 may have a complementary shape to the open area 124 so that it can be selectively received within the open area 124. The edge portion 144 also preferably has a pin housing portion 148.

The roller arm portion 146 is preferably oriented substantially transverse to the edge portion 144. The roller arm portion 146 defines two roller arms 150. The roller arms 150 may be substantially parallel to one another and they may extend substantially perpendicularly from the roller arm portion 146. A roller 152, such as described above, is rotatably mounted between the arms 150 for selective engagement with the roller flange 130. The roller 152 selectively extends over the curvilinear portion 134 of the roller flange 130 to selectively engage with the roller groove 138 of the middle portion 136 to locate the roller flange 130 between the roller 152 and the roller arm portion 146.

Preferably, the edge portion 144, the roller arm portion 146, the pin housing portion 148 and the roller arms 150 are one-piece and unitary.

A pin 154 is located through the frame attachment portion 114 and the door attachment portion 142 to pivotally connect them.

Figure 6E:
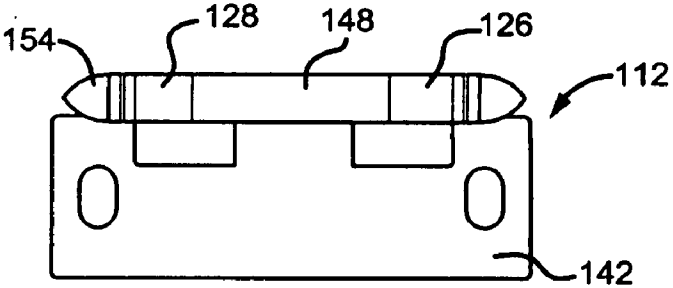
FIGS. 6A-E are schematic views of the components of FIGS. 4A-D and FIGS. 5A-D assembled to one another.
Figure 6A:
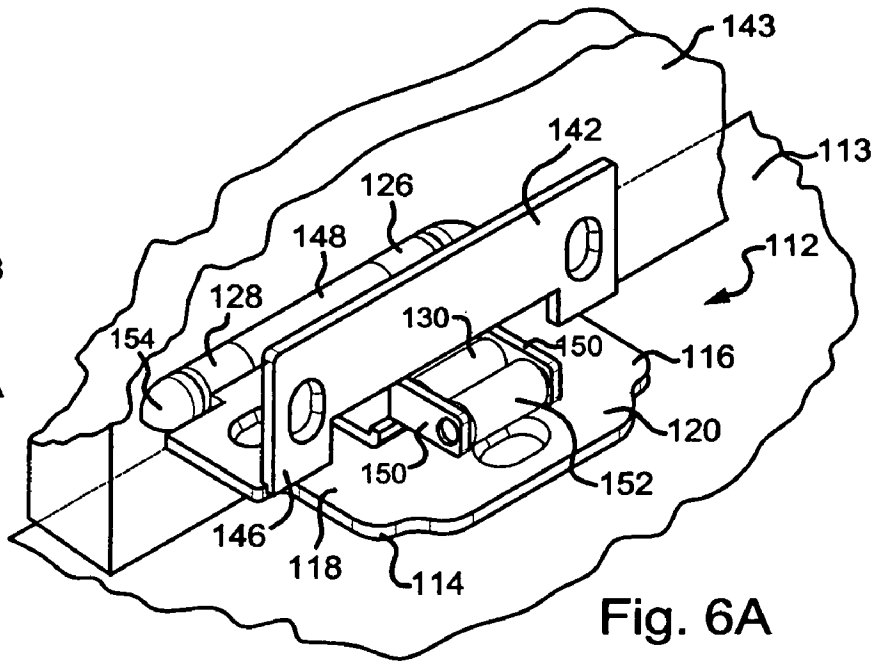
Figure 6D:
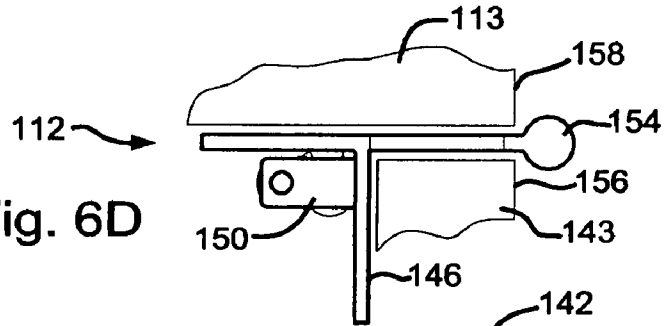
Figure 6C:
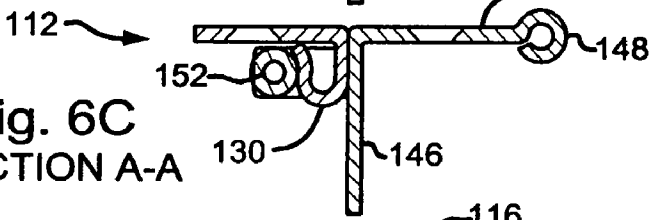
Figure 6B:
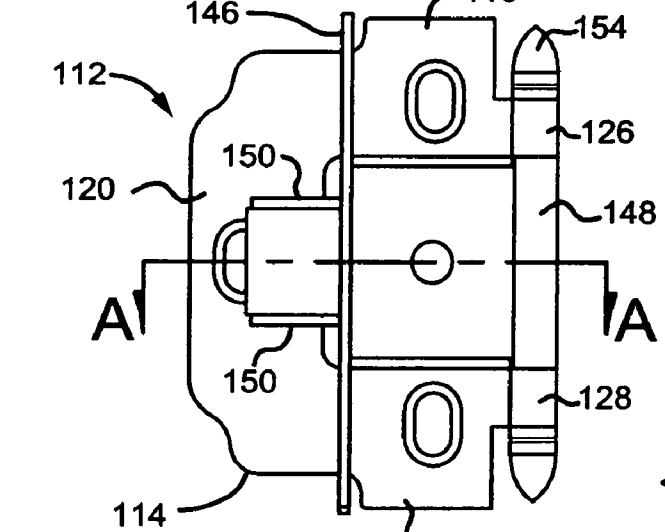

In view of the foregoing, and based on FIGS. 6A and 6D, it can be appreciated that the hinge 112 enables a cabinet door to sit flush with its associated cabinet frame and provide substantially planar door and frame outer surfaces 156, 158. This is due, in part, because the edge portion 144 sits within the open area 124 of the frame attachment portion 114. Additionally, the hinge 112 biases the door shut in the frame so that it is unlikely to open without a force, such as someone pulling the door open. This is achieved, in part, by the roller 152 extending over the curvilinear upper portion 134 and then resting in the roller groove 18. It can also be appreciated that in the closed position, the only parts of the hinge 112 that can be seen are the pin housings 126, 128, 148 and perhaps a decorative portion of the pin 154 that may extend above and below the housings 126, 128.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A hinge, comprising:

a frame attachment portion comprising:

an open area enclosed by a perimeter portion;

at least one pin housing;

a roller flange extending from and being perpendicular to said frame attachment portion;

wherein said perimeter portion, said pin housing and said roller flange being unitary with one another;

a door attachment portion comprising:

an edge portion having a complementary shape to said open area of said frame attachment portion for being selectively received therein;

an inner portion and an outer portion being perpendicular to said edge portion and, said outer portion having a flange extending perpendicular to said door attachment portion and a pin extending perpendicular to said flange wherein a spring is located about said pin, said spring having a first leg extending in a first direction and a second leg extending in a second opposite direction, said second leg supporting a roller thereon;

wherein said edge portion, said inner portion, said flange and a pin housing on said edge portion are unitary with one another.

2. The hinge of claim 1, wherein said second leg of said spring has a first portion, a second portion perpendicular to said first portion supporting said roller and a third portion perpendicular to said second portion, said third portion being fixed to said door attachment portion.

3. The hinge of claim 1, wherein said roller flange has a curvilinear rear portion for selectively receiving said roller including an upper portion and a groove, said groove selectively retaining said roller therein.

4. The hinge of claim 1, wherein said roller flange is symmetrical.

5. The hinge of claim 1, wherein said roller flange has a base that tapers down to a middle portion and said middle portion supports a wedge shaped head portion.

6. A hinge, comprising:

a U-shaped frame attachment portion comprising a first leg, a second leg and a leg connector forming an inner edge that defines an open area, said first leg and said second leg each having separate pin housings, said legs, said leg connector and said pin housings being unitary with one another;

a roller flange, unitary with said leg connector, extending perpendicularly from said inner edge of said frame attachment portion;

a door attachment portion comprising an edge portion having a complementary shape to said open area for being selectively received therein, and a pin housing portion;

a roller arm portion transverse to said edge portion defining two roller arms, said roller arms being parallel to one another and extending perpendicular to said roller arm portion;

wherein said edge portion, said roller arm portion, said pin housing portion and said roller arms are unitary with one another.

7. The hinge of claim 6, wherein said roller flange has a rear portion attached to said leg connector, a curvilinear upper portion, a middle portion defining a roller groove and a terminal portion terminating adjacent said frame attachment portion.

8. The hinge of claim 7, wherein a roller extends over said curvilinear upper portion of said roller flange to selectively engage with said roller groove of said middle portion to locate said roller flange between said roller and said roller arm portion.

9. The hinge of claim 6, wherein a roller is rotatably mounted between said arms for elective engagement with said roller flange.

10. The hinge of claim 6, wherein a pin is located through said frame attachment portion and said door attachment portion to pivotally connect them.

11. A system for selectively locating a door within a frame, comprising:

a frame;

a door selectively located within said frame;

a hinge having a frame attachment portion and a door attachment portion, wherein said portions are pivotally connected to one another via a pin, wherein said frame attachment portion and door attachment portion cooperate to cause an outside surface of said door to be flush with an outside surface of said frame when said door is substantially within said frame, said door attachment portion comprising a male portion that is selectively and entirely received within a hollow complementary shaped female portion on said frame attachment portion when said door is substantially within said frame, and wherein said frame attachment portion has a unitary roller flange extending substantially transverse thereto that selectively engages with a roller on said door attachment portion, said roller flange having integrally formed therewith a roller securing portion.

12. A hinge, comprising:

a frame attachment portion comprising:

an open area enclosed by a perimeter portion;

at least one pin housing;

an upstanding portion extending from and being perpendicular to said frame attachment portion, said upstanding portion having a base portion, a middle portion and a wedge-shaped upper portion;

wherein said perimeter portion, said pin housing and said upstanding portion being unitary with one another;

a door attachment portion comprising:

an edge portion having a complementary shape to said open area of said frame attachment portion for being selectively received therein;

an inner portion and an outer portion being perpendicular to said edge portion and, said outer portion having a first upstanding flange and a second upstanding flange, both flanges extending perpendicular to said door attachment portion and a pair of rollers extending perpendicular to said flanges, said rollers separated by a gap;

wherein said outer portion, said inner portion, and said flanges on said edge portion are unitary with one another.

* * * * *